US010279278B2

(12) United States Patent
Sakai

(10) Patent No.: US 10,279,278 B2
(45) Date of Patent: May 7, 2019

(54) FUSIBLE TOY BEAD SCRAPER SET

(71) Applicant: EPOCH COMPANY, LTD., Tokyo (JP)

(72) Inventor: Ryo Sakai, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 15/483,232

(22) Filed: Apr. 10, 2017

(65) Prior Publication Data

US 2017/0291115 A1 Oct. 12, 2017

(30) Foreign Application Priority Data

Apr. 11, 2016 (JP) ..... 2016-078681

(51) Int. Cl.

| | |
|---|---|
| ***G09B 19/00*** | (2006.01) |
| ***A63H 33/00*** | (2006.01) |
| ***A63F 9/06*** | (2006.01) |
| *A63F 11/00* | (2006.01) |

(52) U.S. Cl.

CPC ..... *A63H 33/00* (2013.01); *A63F 9/06* (2013.01); *A63F 2011/0048* (2013.01)

(58) Field of Classification Search

CPC ..... A63H 33/00; A63H 33/22; B44C 3/123

USPC ..... 446/86, 118; 434/96

See application file for complete search history.

(56) References Cited

U.S. PATENT DOCUMENTS 1,412,728 A * 4/1922 Werner ..... B27G 17/04 30/169
3,643,328 A 2/1972 Wainwright, Jr.
3,724,110 A * 4/1973 Meyerson ..... G09F 9/37 40/449
4,496,510 A * 1/1985 Hanson ..... A63H 33/22 264/246
4,585,234 A * 4/1986 Alsip ..... A63F 3/00094 273/271
4,777,693 A * 10/1988 Diba ..... A46B 3/005 15/105

(Continued)

FOREIGN PATENT DOCUMENTS

CN 201511693 U 6/2010
CN 101898039 A 12/2010

(Continued)

OTHER PUBLICATIONS

JP Notification of Reasons for Refusal dated Dec. 15, 2016 for JP 2016-078681, including English translation.

(Continued)

*Primary Examiner* — Alvin Hunter
*Assistant Examiner* — Joseph B Baldori
(74) *Attorney, Agent, or Firm* — Drinker Biddle & Reath LLP

(57) ABSTRACT

A fusible toy bead scraper set includes: a main body; a spatula portion formed on a front side of the main body; and guide portions. The guide portions extend from left and right end surface of the main body to define a space between left and right end portions of the main body, have lower surfaces, and are disposed on left and right sides of the main body, for guiding forward and rearward movement of the spatula portion. The set also includes fusible toy beads and a rectangular holding tray.

6 Claims, 7 Drawing Sheets

(56) References Cited

U.S. PATENT DOCUMENTS 4,779,301 A * 10/1988 Millette ..... E04G 23/006 15/105
4,905,338 A * 3/1990 Mascia ..... A63C 11/08 15/236.01
4,964,802 A * 10/1990 Weller ..... A63F 9/06 434/96
4,986,756 A * 1/1991 Yamaguchi ..... A63F 9/06 273/157 R
5,074,775 A * 12/1991 Jeannert ..... A23G 1/206 264/39
5,704,789 A * 1/1998 Yang ..... B44C 3/123 221/185
5,706,592 A * 1/1998 Sinclair, Jr. ..... B62B 1/147 222/192
6,032,393 A * 3/2000 Maxim ..... G09F 9/305 40/547
6,163,919 A * 12/2000 Mitchell ..... A47L 1/16 15/143.1
6,612,050 B2 * 9/2003 Takeuchi ..... E01H 5/061 37/232
6,733,056 B2 * 5/2004 Daniele ..... A47J 43/28 294/180
7,000,564 B2 * 2/2006 Franczyk ..... A23G 3/28 118/13
7,011,789 B1 * 3/2006 Bowlin ..... B23K 7/10 148/196
7,814,610 B2 * 10/2010 Weinberger ..... A47L 1/16 15/143.1
8,726,450 B2 * 5/2014 Hoffmann ..... E04F 21/0084 15/236.01
8,827,711 B2 * 9/2014 Davis, II ..... G09F 5/02 434/96
2009/0265940 A1 10/2009 Wahl
2009/0320299 A1 12/2009 Kuhn et al.
2012/0011675 A1 * 1/2012 Goble ..... A47L 13/022 15/236.01
2013/0183881 A1 7/2013 Kamiyama
2018/0043276 A1 2/2018 Sakai

FOREIGN PATENT DOCUMENTS

CN 202463145 U 10/2012
CN 202777814 U 3/2013
CN 103203106 A 7/2013
DE B3-10 2006 046 659 6/2008
JP S56-039680 Y 9/1981
JP S59-2600 U1 1/1984
JP 3048620 U 5/1998
JP B1-6108650 8/2006
JP 3131292 U 4/2007

OTHER PUBLICATIONS

Chinese Office Action issued in Application No. 201710233538.0 dated Apr. 3, 2018 along with its English-language translation.
DE Office Action dated Feb. 6, 7018 in German Application No. 102017107840.1 with English language translation.
DE Office Action dated Jun. 14, 2018 from corresponding German patent application No. 102017107840.1 (with attached English-language translation).

* cited by examiner

FUSIBLE TOY BEAD SCRAPER SET

CROSS-REFERENCES TO RELATED APPLICATIONS

This application is based upon and claims priority from Japanese Patent Application No. 2016-078681 filed on Apr. 11, 2016, the entire contents of which are incorporated herein by reference.

FIELD

One or more embodiments of the present invention relate to a fusible toy bead scraper to be used for removing, from a holding tray, a plurality of fusible toy beads placed on the holding tray.

BACKGROUND

Fusible toy beads using granular beads made of a water-soluble resin have been conventionally provided. Japanese Utility Model Registration No. 3131292 discloses a bead toy set including: a holding tray on which a plurality of recesses are formed to place fusible toy beads therein; a base tray; and a sheet to be inserted between the holding tray and the base tray. Here, a pattern is drawn on this sheet, and when a user places fusible toy beads on the holding tray in accordance with the pattern, it is possible to create assemblies of the fusible toy beads in various shapes.

These fusible toy beads are formed into a granular shape by, for example, mixing and kneading polyvinyl alcohol with a resin. After placing the fusible toy beads on the holding tray, when water is supplied thereto with a spray or the like to place the fusible toy beads in a wet state, the fusible toy beads are melted. When the fusible toy beads are dried thereafter by allowing them to stand still for a prescribed period of time, the melted resin is cured, and hence the fusible toy beads are bonded to one another. In this manner, a user, mainly a child, can enjoy creating an assembly of the fusible toy beads in a desired pattern.

SUMMARY

In supplying water to fusible toy beads, a sufficient amount of water is supplied so that the fusible toy beads can be definitely melted. An excessive portion of the water gathers in a concave portion of a holding tray after sufficiently wetting the fusible toy beads. Then, when the fusible toy beads to which the water has been supplied are naturally dried, surfaces of the beads on the upper surface side are first dried, and their surfaces on the under surface side (namely, a side facing the holding tray) are dried more slowly than the surfaces on the upper surface side. Here, each fusible toy bead slightly shrinks when dried and cured. Accordingly, an assembly of the fusible toy beads left on the holding tray to be dried may be completed in a curved state in some cases because its surface on the upper surface side has first dried and shrunk. This may reduce a pleasure of a child playing with the fusible toy beads.

If the fusible toy beads are to be removed with fingers at an early stage before being completely dried in order to prevent the curve of an assembly of the fusible toy beads otherwise occurring after the drying, since the fusible toy beads are not completely bonded to one another, the assembly of the fusible toy beads carefully aligned may come apart in some cases. Alternatively, if the holding tray is turned upside down to remove the assembly of the fusible toy beads therefrom, the water gathered in the concave portion of the holding tray unavoidably scatters. Since the water gathered in the concave portion contains a pasty component, it may be troublesome to wipe up the water. Alternatively, if the fusible toy beads are to be removed with any of commercially available members such as various types of spatulas, it is difficult to successfully remove the fusible toy beads because it is difficult for a child to move straight the member such as a spatula.

An object of one or more embodiments of the present invention is to provide a fusible toy bead scraper with which an assembly of fusible toy beads can be removed from a holding tray at an early stage so as to reduce curve occurring in the assembly of the fusible toy beads after drying.

A fusible toy bead scraper according to one aspect of the present invention includes: a main body; a spatula portion formed on a front side of the main body; and guide portions which extend from left and right end surface of the main body to define a space between left and right end portions of the main body, which have lower surfaces, and which are disposed on left and right sides of the main body, for guiding forward and rearward movement of the spatula portion.

According to the one or more embodiments of the present invention, a fusible toy bead scraper with which an assembly of fusible toy beads can be easily removed from a holding tray even before the elapse of a prescribed time period necessary for sufficiently curing and bonding the assembly of the fusible toy beads placed on the holding tray.

DETAILED DESCRIPTION

Figure 1:
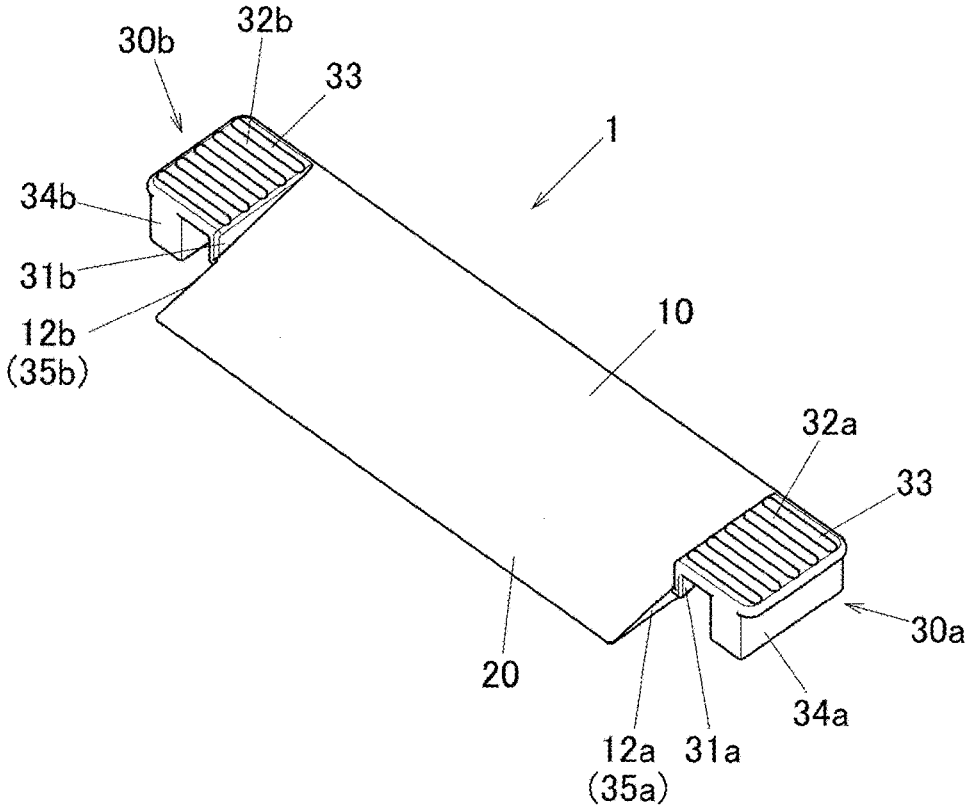
FIG. 1 is a perspective view, taken from above, of a fusible toy bead scraper according to an embodiment of the present invention.
Figure 2:
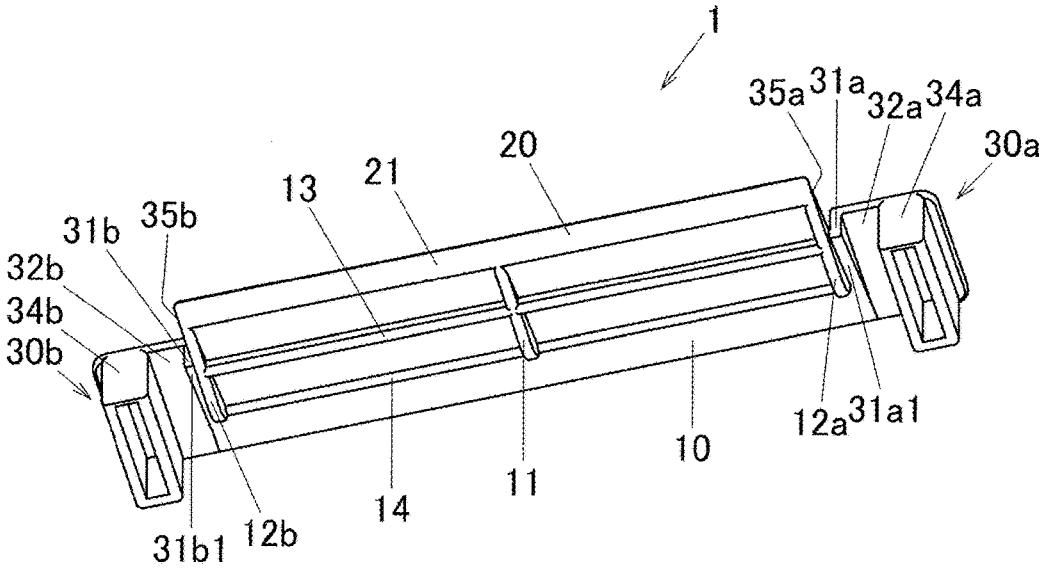
FIG. 2 is a perspective view, taken from below, of the fusible toy bead scraper according to the embodiment of the present invention.

An embodiment of the present invention will now be described with reference to the accompanying drawings. FIG. 1 is a perspective view, taken from above, of a fusible toy bead scraper 1. FIG. 2 is a perspective view, taken from below, of the fusible toy bead scraper 1. The fusible toy bead scraper 1 includes a main body 10 formed in a laterally long rectangular shape in a plan view. The main body 10 includes a spatula portion 20. Incidentally, in the following description, a side of the spatula portion 20 is referred to as the front, and a side opposite to the spatula portion 20 is referred to as the rear. In addition, a left hand side and a right hand side when seen forward from the rear are referred to respectively as the left and the right.

When the fusible toy bead scraper 1 is placed on a holding tray 50 or 60 illustrated in FIGS. 3 to 7 and the spatula portion 20 is moved forward, an assembly of fusible toy beads 80 placed on the holding tray 50 or the like can be removed in a short period of time shorter than a prescribed time period necessary for sufficiently curing and bonding the assembly of the fusible toy beads 80. First, the structure of the fusible toy bead scraper 1 will be described with reference to FIGS. 1 and 2.

The upper surface of the spatula portion 20 is formed as a surface continuous from the upper surface of the main body 10, specifically as a continuous flat surface. The lower surface of the spatula portion 20 is formed as a laterally long flat surface 21. The flat surface 21 is horizontally formed. The upper surface of the spatula portion 20 is inclined at a prescribed angle against the flat surface 21 to extend upward from the front to the rear.

As illustrated in FIG. 2, on the lower surface of the main body 10, a center vertical plate portion 11 and left and right vertical plate portions 12*a* and 12*b* each in the shape of a vertical plate extending in a front-to-rear direction are formed respectively in the center and at the right and left ends of the main body 10. Besides, a lateral beam portion 13 in a laterally long beam shape is formed on the lower surface of the main body 10.

In substantially centers in the front-to-rear direction of the center vertical plate portion 11 and the left and right vertical plate portions 12*a* and 12*b*, the lateral beam portion 13 joins the center vertical plate portion 11 with the left and right vertical plate portions 12*a* and 12*b*. Besides, the flat surface 21 corresponding to the lower surface of the spatula portion 20 and the lower surfaces of the center vertical plate portion 11 and the left and right vertical plate portions 12*a* and 12*b*, and the lower surface of the lateral beam portion are formed as a horizontally continuous surface. Furthermore, a continuous projection 14 is formed at the rear ends of the center vertical plate portion 11 and the left and right vertical plate portions 12*a* and 12*b*. The continuous projection 14 is formed to be laterally long, and is provided to protrude from the lower surface of the main body 10 so as to join the center vertical plate portion 11 with the left and right vertical plate portions 12*a* and 12*b*.

On the left and right sides of the main body 10, plate-shaped guide portions 31*a* and 31*b* in the shape of a vertical plate are respectively formed. The plate-shaped guide portions 31*a* and 31*b* are formed to protrude outward respectively from outer surfaces 35*a* and 35*b* of the left and right vertical plate portions 12*a* and 12*b* (in other words, left and right side surfaces of the main body 10) so as to have flat surfaces thereof parallel to the outer surfaces 35*a* and 35*b*. Lower surfaces 31*a*1 and 31*b*1 of the plate-shaped guide portions 31*a* and 31*b* illustrated in FIG. 2 are formed to be inclined against the flat surface 21 of the spatula portion 20 and to be parallel to the upper surface of the main body 10.

Lateral plate portions 32*a* and 32*b* protruding left and right outward in a plate shape are respectively formed to protrude from upper ends of the plate-shaped guide portions 31*a* and 31*b*. On upper surfaces of the lateral plate portions 32*a* and 32*b*, a plurality of ridges 33 laterally extending are disposed in the front-to-rear direction to form non-slip portions.

Block-shaped guide portions 34*a* and 34*b* are formed to protrude, in a block shape, downward respectively from the lower surfaces of the lateral plate portions 32*a* and 32*b*. The block-shaped guide portions 34*a* and 34*b* are formed as hollow members. The lower surfaces of the block-shaped guide portions 34*a* and 34*b* are formed to be horizontal. In addition, the lower surfaces of the block-shaped guide portions 34*a* and 34*b* are positioned below the flat surface 21 corresponding to the lower surface of the spatula portion 20.

The plate-shaped guide portions 31*a* and 31*b*, the block-shaped guide portions 34*a* and 34*b* and the outer surfaces 35*a* and 35*b* of the vertical plate portions 12*a* and 12*b* together work respectively as guide portions 30*a* and 30*b* for guiding the forward movement of the spatula portion 20 (namely, the main body 10). As described above, the guide portions 30*a* and 30*b* are disposed on the left and right sides of the main body 10. Besides, the plate-shaped guide portions 31*a* and 31*b* and the block-shaped guide portions 34*a* and 34*b* are disposed with their opposing side surfaces spaced from each other at a prescribed distance.

Figure 3:
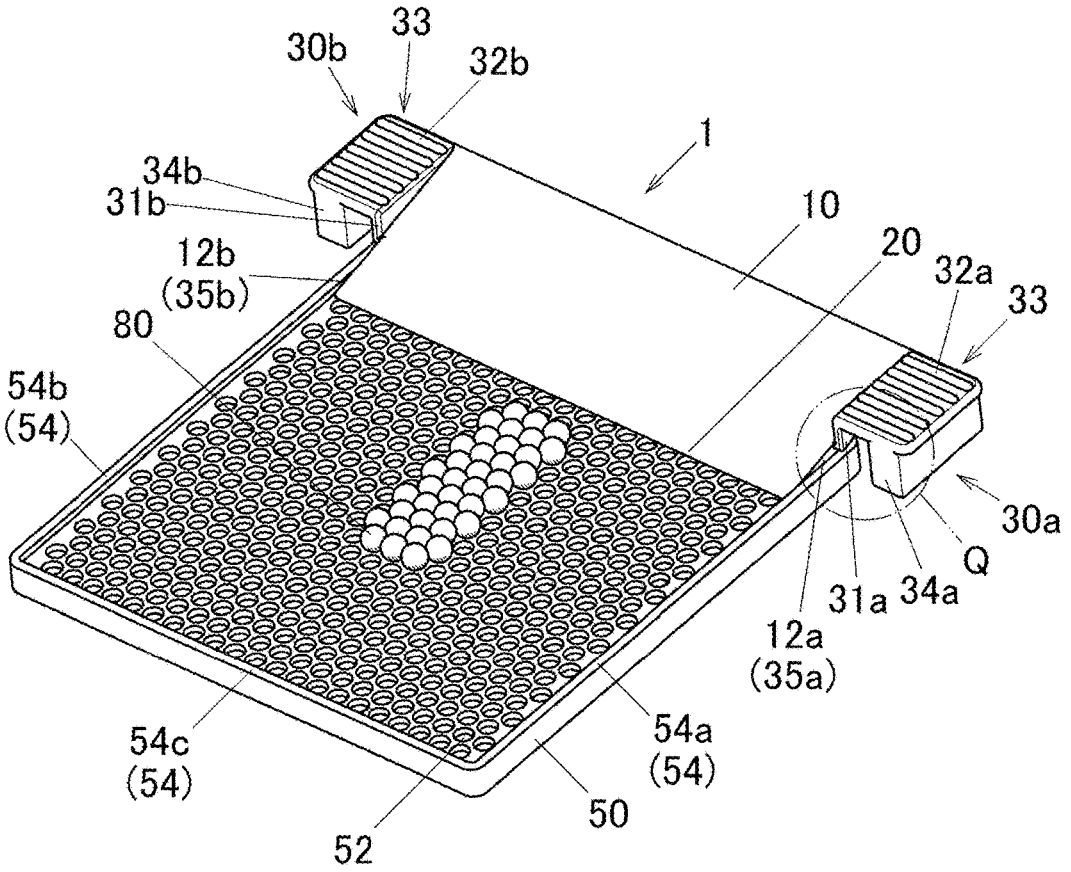
FIG. 3 is a perspective view of a state where the fusible toy bead scraper according to the embodiment of the present invention is placed on a holding tray.
Figure 4:
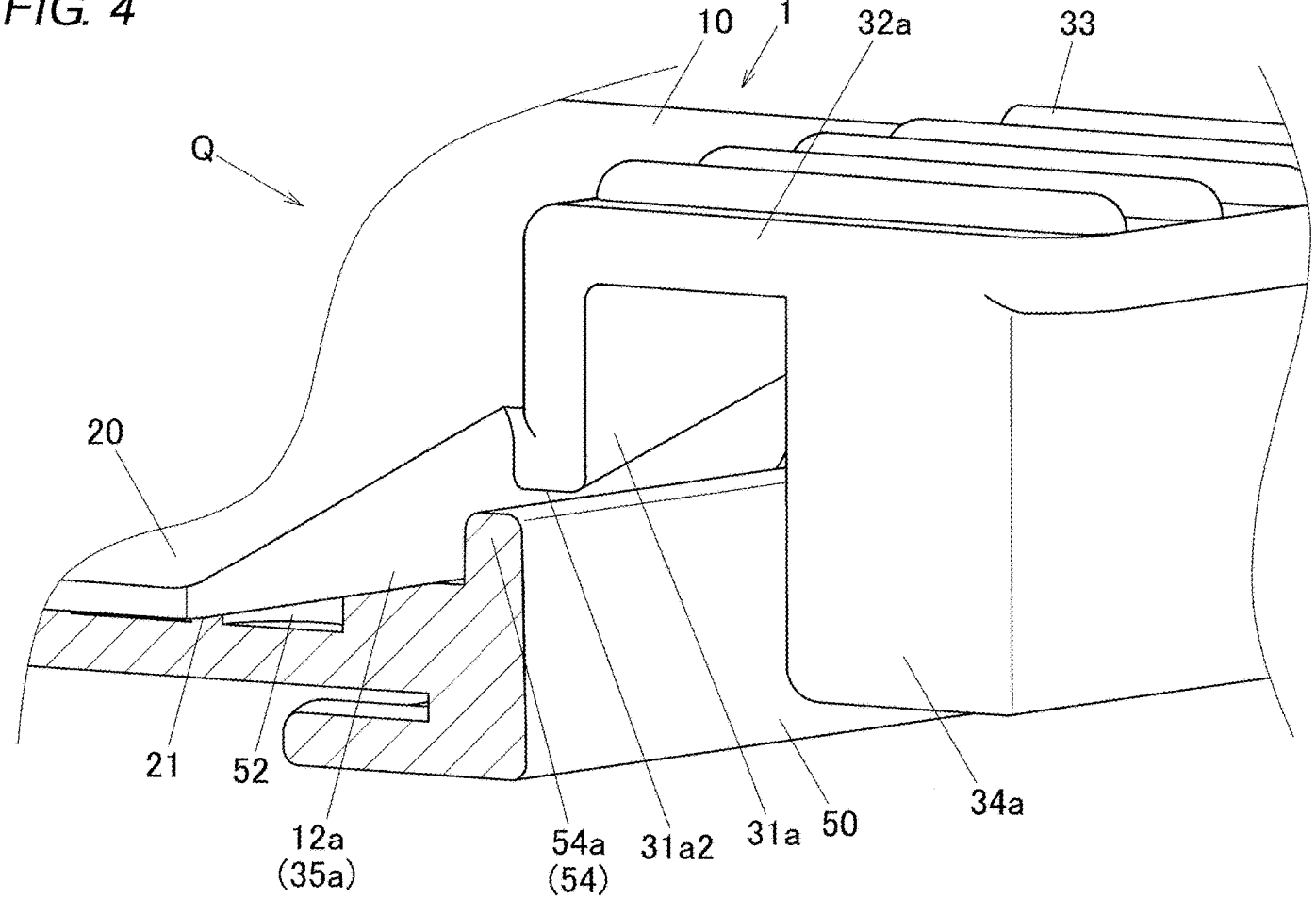
FIG. 4 is a perspective view enlargedly illustrating a part Q of FIG. 3 in the state where the fusible toy bead scraper according to the embodiment of the present invention is placed on the holding tray, with a part of the holding tray illustrated as a cross-section.

The fusible toy bead scraper 1 having the aforementioned structure can be placed on, for example, the holding tray 50 illustrated in FIG. 3. On the holding tray 50, a plurality of fusible toy beads 80 spherically formed are placed and arranged. Here, any of known toy beads may be used as each of the fusible toy beads 80. The fusible toy bead 80 is formed, for example, by mixing and kneading polyvinyl alcohol with a resin. Although the fusible toy beads 80 are in a spherical shape in the present embodiment, the beads may be formed in another shape of, for example, a polyhedral shape. Besides, fusible toy beads 80 in various colors can be used.

Besides, any of known holding trays may be used as the holding tray 50 together with the fusible toy beads 80. The holding tray 50 is formed in the shape of a square plate in a plan view. A plurality of circular recesses 52 are provided on a surface of the holding tray 50. The recesses 52 are disposed to be offset in different rows (or columns). Thus, six fusible toy beads 80 can be radially placed in the recesses 52 around and adjacent to one fusible toy bead 80 placed in one recess 52. Besides, the diameter of each recess 52 is set to be smaller than the diameter of each fusible toy bead 80, and a distance between the centers of the recesses 52 adjacent to each other is set so that the fusible toy beads 80 disposed in the adjacent recesses 52 can be in contact with each other or slightly spaced from each other. Incidentally, the other known holding trays include one in the shape of a circle or the like, and one having the recesses 52 disposed not to be offset but in parallel.

Besides, the holding tray 50 includes wall-shaped edge walls 54 formed in four outer edges thereof. Specifically, the edge walls 54 include a left edge wall 54*a*, a right edge wall 54*b*, a front edge wall 54*c* and a rear edge wall 54*d* (see FIGS. 5 and 6) formed to be linked to one another and to form round corners. A face-to-face distance between the edge walls 54 opposing each other (for example, a distance between the inner surface of the left edge wall 54*a* and the inner surface of the right edge wall 54*b*) is set to be slightly larger than a distance between the outer surfaces 35*a* and 35*b* of the main body 10 of the fusible toy bead scraper 1. Therefore, the left and right vertical plate portions 12*a* and 12*b* are disposed inside the edge walls 54 (i.e., the left edge wall 54*a* and the right edge wall 54*b*) opposing each other. Here, the outer surfaces 35*a* and 35*b* of the vertical plate portions 12*a* and 12*b* are close to or in contact with the inner surfaces of the edge walls 54 (i.e., the left edge wall 54*a* and the right edge wall 54*b*).

Furthermore, on the upper surfaces of the edge walls 54 (i.e., the left edge wall 54*a* and the right edge wall 54*b*), the lower surfaces 31*a*1 and 31*b*1 of the plate-shaped guide portions 31*a* and 31*b* are disposed opposingly. The upper surfaces of the edge walls 54 (i.e., the left edge wall 54*a* and the right edge wall 54*b*) are close to or in contact with front end portions (one of which corresponds to a front end portion 31*a*2 illustrated in FIG. 4) of the lower surfaces 31*a*1 and 31*b*1 of the plate-shaped guide portions 31*a* and 31*b*. Besides, the lower surfaces of the block-shaped guide portions 34*a* and 34*b* are spaced at a prescribed distance from a plane, such as a desktop, where the holding tray 50 is placed.

Besides, the flat surface 21 corresponding to the lower surface of the spatula portion 20, the lower surfaces of the center vertical plate portion 11 and the left and right vertical plate portions 12*a* and 12*b* and the lower surface of the lateral beam portion 13 are in contact with the surface of the holding tray 50 where the recesses 52 are formed.

Water is supplied, with a spray or the like, to the plural fusible toy beads 80 placed on the holding tray 50, and after the elapse, from the supply of the water, of a prescribed time (of, for example, about 30 minutes to 60 minutes) necessary for sufficiently curing and bonding, the fusible toy beads 80 thus wetted to melt are dried and cured, resulting in bonding with one another. The fusible toy bead scraper 1 is used for removing an assembly of the fusible toy beads 80 thus obtained from the holding tray 50 in a short period of time (of, for example, about 15 minutes to 20 minutes) shorter than the prescribed time necessary for sufficiently curing and bonding the fusible toy beads 80. Here, in the short period of time shorter than the prescribed time necessary for sufficiently curing and bonding the fusible toy beads 80, the fusible toy beads 80 are in a state where the exposed upper surfaces of the plural fusible toy beads 80 are already started to cure but the surfaces on the side of the recesses 52 of the holding tray 50 are still wet. If the assembly of the fusible toy beads 80 in this state is pulled with fingers with a given force, the fusible toy beads 80 come apart, but if, for example, one end of the assembly is grasped and hung, the fusible toy beads 80 do not come apart with their own weights. Incidentally, in FIGS. 3, 5 and 6, hatched portions of the fusible toy beads 80 illustrate that these portions are wet.

Now, procedures for removing the assembly of the fusible toy beads 80 with the fusible toy bead scraper 1 will be described. Water is supplied to the assembly of the fusible toy beads 80 placed on the holding tray 50, and after the elapse of the short period of time (of, for example, about 15 minutes to 20 minutes) shorter than the prescribed time necessary for sufficiently curing and bonding the assembly of the fusible toy beads 80, the fusible toy bead scraper 1 is placed on the holding tray 50 as illustrated in FIG. 3. Then, the fusible toy bead scraper 1 is moved forward. At this point, the fusible toy bead scraper 1 can be moved forward with the non-slip portions having the ridges 33 pushed with fingers, or with the rear surfaces of the block-shaped guide portions 34*a* and 34*b* pushed with fingers.

The fusible toy bead scraper 1 is disposed with the outer surfaces 35*a* and 35*b* of the vertical plate portions 12*a* and 12*b* or the front end portions (such as the front end portion 31*a*2 illustrated in FIG. 4) of the plate-shaped guide portions 31*a* and 31*b* movably along the edge walls 54, and therefore, the forward movement of the spatula portion 20 is definitely guided.

Figure 5:
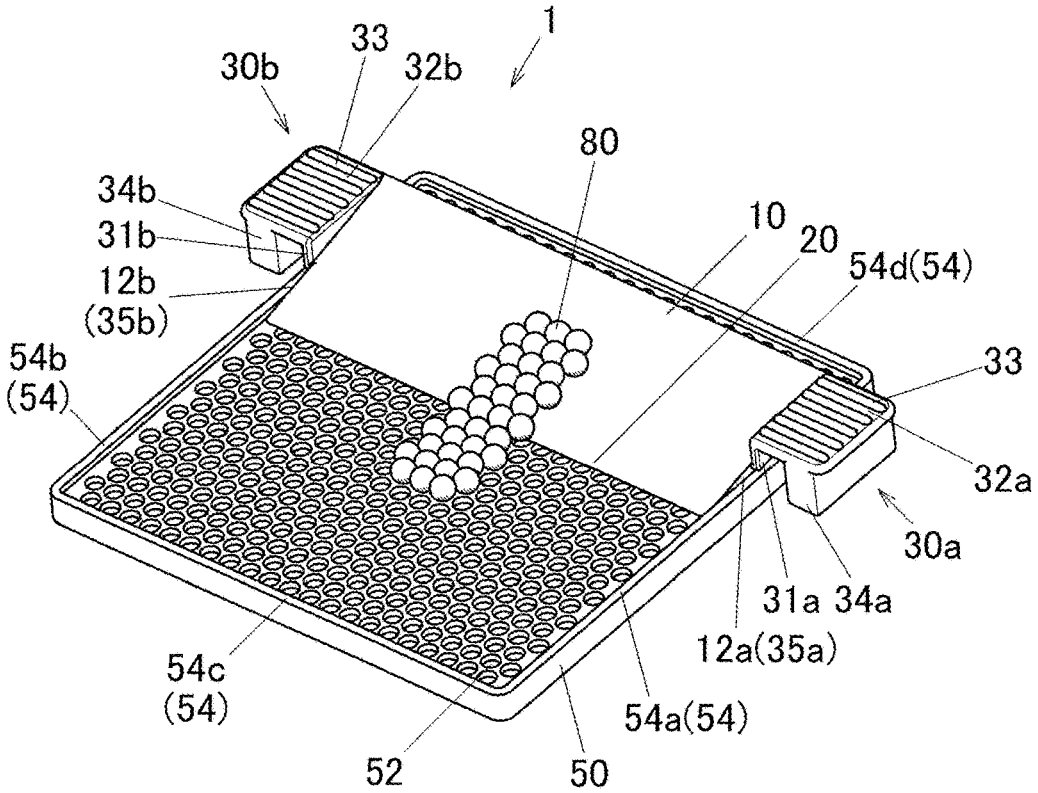
FIG. 5 is a perspective view illustrating a state where fusible toy beads are removed by moving forward the fusible toy bead scraper according to the embodiment of the present invention having been placed on the holding tray.

When the fusible toy bead scraper 1 is moved forward, the assembly of the fusible toy beads 80 is successively removed from the holding tray 50 by the spatula portion 20 as illustrated in FIG. 5. At this point, since the lower surfaces of the fusible toy beads 80 are still wet, the fusible toy beads 80 can be easily removed from the holding tray 50. On the other hand, since the upper surfaces of the fusible toy beads 80 have already started to cure, the fusible toy beads 80 are bonded to one another. Accordingly, the assembly of the fusible toy beads 80 removed by the spatula portion 20 is removed from the holding tray 50 without coming apart. Then, the assembly of the fusible toy beads 80 thus successively sent onto the upper surface of the spatula portion 20 is successively sent onto the upper surface of the main body 10.

Figure 6:
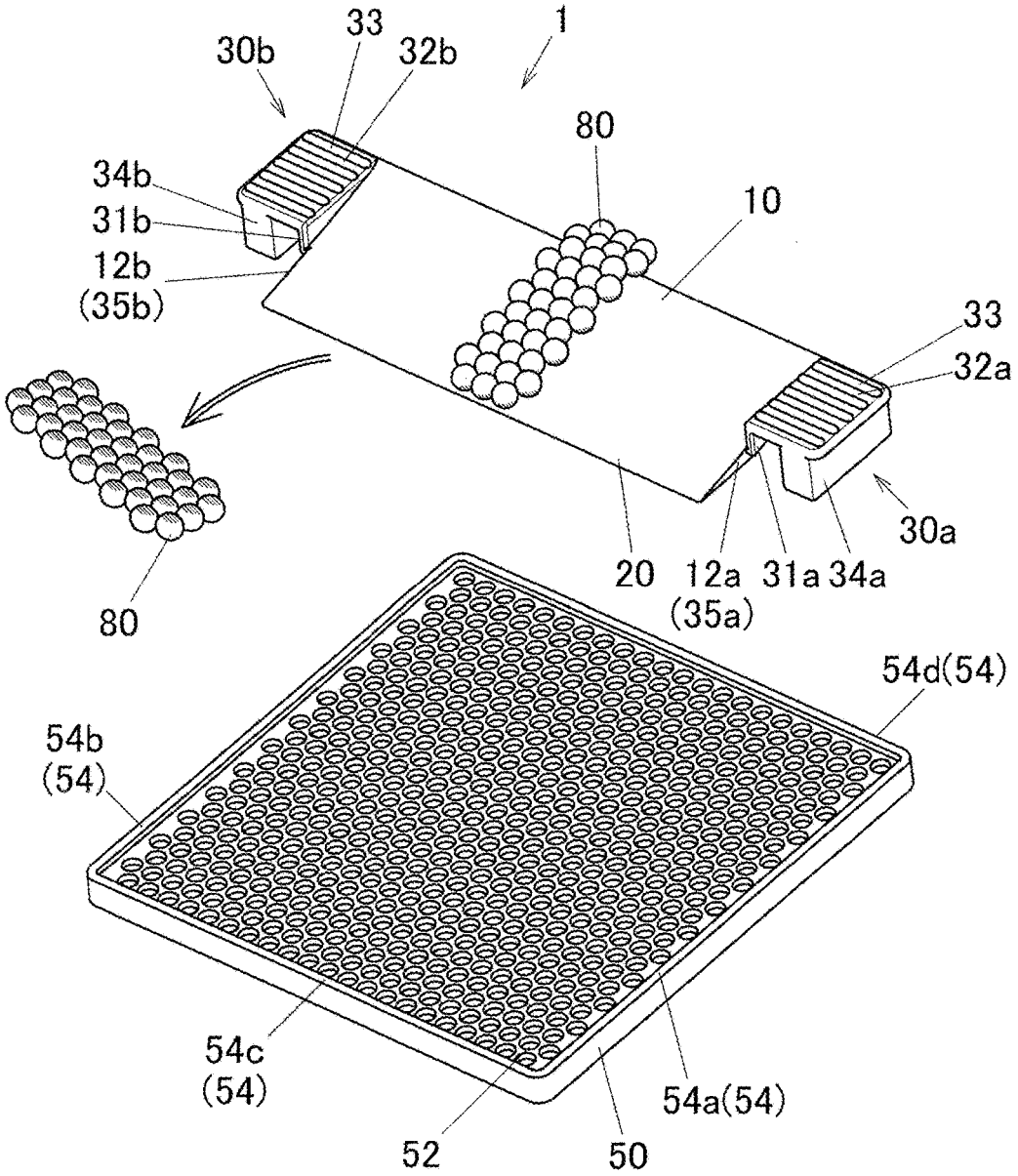
FIG. 6 is a perspective view illustrating a state where the fusible toy beads have been removed from the holding tray using the fusible toy bead scraper according to the embodiment of the present invention.

When the assembly of the fusible toy beads 80 is completely removed from the holding tray 50, the fusible toy bead scraper 1 is lifted up as illustrated in FIG. 6. Then, the assembly of the fusible toy beads 80 is placed on a desktop or the like with the assembly turned upside down so that the wet lower surfaces of the fusible toy beads 80 can face upward. Thus, the fusible toy beads 80 are disposed with their wet surfaces facing upward, and hence, the curing of the wet surfaces is accelerated as compared with the other surfaces having already started to cure. Accordingly, the assembly of the fusible toy beads 80 is substantially uniformly cured as compared with a case where the assembly is left to cure on the holding tray 50. As a result, curve of the assembly of the fusible toy beads 80 occurring when one surface of the assembly has priorly cured and shrunk is reduced.

Besides, when the aforementioned procedures are employed, the assembly of the fusible toy beads 80 can be removed from the holding tray 50 earlier than a case where the assembly of the fusible toy beads 80 is left on the holding tray 50 to completely cure. Accordingly, a user can earlier start to create another assembly of the fusible toy beads 80.

Figure 7:
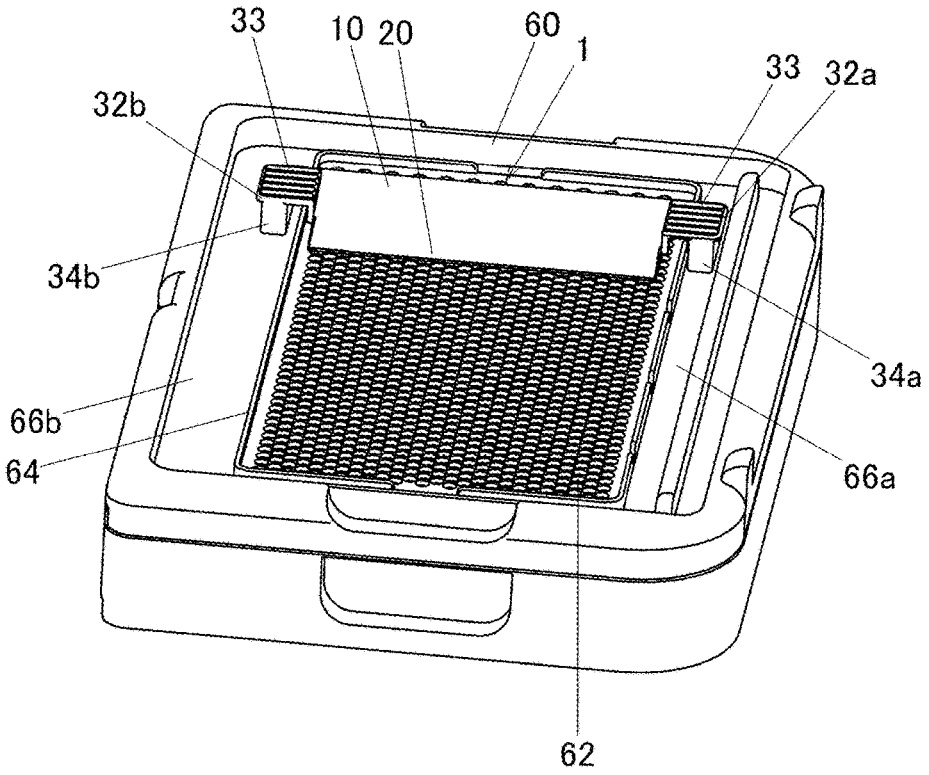
FIG. 7 is a perspective view illustrating a state where the fusible toy bead scraper according to the embodiment of the present invention is placed on a holding tray of another aspect.

In addition, as illustrated in FIG. 7, the fusible toy bead scraper 1 can be used in the holding tray 60 larger than the above-described holding tray 50. The holding tray 60 is provided with a plurality of recesses 62 similar to the recesses 52 of the holding tray 50 described above. In the periphery of the plural recesses 62, edge walls 64 are provided to vertically rise in the shape of a wall. Here, on the upper surface of the holding tray 60, side upper surfaces 66*a* and 66*b* disposed outside of left and right edge walls 64 are formed at a level lower than the surface where the plural recesses 62 are formed.

Also in the plural recesses 62 of this holding tray 60, a plurality of fusible toy beads 80 can be disposed in an arbitrary pattern. Then, in the same manner as in the aforementioned procedures, an assembly of the fusible toy beads 80 can be removed from the holding tray 60.

Here, when the fusible toy bead scraper 1 is placed on the holding tray 60, the lower surfaces of the left and right block-shaped guide portions 34*a* and 34*b* come close to or into contact with the side upper surfaces 66*a* and 66*b*. Accordingly, when the fusible toy bead scraper 1 is moved forward, the spatula portion 20 can be moved forward with the fusible toy bead scraper 1 stabilized by the lower surfaces of the left and right block-shaped guide portions 34*a* and 34*b* and the side upper surfaces 66*a* and 66*b*.

According to the embodiment of the present invention described so far, a fusible toy bead scraper having any of the following aspects can be provided.

A fusible toy bead scraper according to a first aspect of the present invention includes: a main body; a spatula portion formed on a front side of the main body; and guide portions which extend from left and right end surface of the main body to define a space between left and right end portions of the main body, which have lower surfaces, and which are disposed on left and right sides of the main body, for guiding forward and rearward movement of the spatula portion.

With this structure, an assembly of fusible toy beads can be removed from a holding tray in a short period of time shorter than a prescribed time necessary for sufficiently curing and bonding the assembly of the fusible toy beads. Accordingly, the curve of the assembly of the fusible toy beads otherwise occurring due to shrinkage caused in the curing can be reduced, and in addition, creation of another assembly of fusible toy beads can be started early. Besides, since movement such as the forward movement of the spatula portion is guided by the guide portions, it is possible to stably move the fusible toy bead scraper in the forward and rearward directions, and the assembly of the fusible toy beads can be easily removed. As a result, the creation with fusible toy beads can be more pleasant for a child playing with the fusible toy beads.

According to a second aspect of the present invention, in the fusible toy bead scraper, the main body is formed in a laterally long rectangular shape in a plan view and having a flat upper surface, and an upper surface of the spatula portion is formed as a flat surface continuous from the upper surface of the main body.

With this structure, in removing the assembly of the fusible toy beads, the assembly of the fusible toy beads is smoothly sent from the upper surface of the spatula portion over to the upper surface of the main body, and hence, can be more easily removed.

According to a third aspect of the present invention, in the fusible toy bead scraper, the guide portions include plate-shaped guide portions which protrude from left and right side surfaces of the main body in parallel to the side surfaces, respectively, to have vertical plate shapes such that the lower surfaces are positioned higher than a lower surface of the main body.

With this structure, the upper surface of an edge wall of a holding tray can be brought close to or into contact with the lower surfaces of the plate-shaped guide portions, and hence, the forward movement of the fusible toy bead scraper can be definitely guided.

According to a fourth aspect of the present invention, in the fusible toy bead scraper, the guide portions include block-shaped guide portions which protrude downward from lower surfaces of lateral plate portions protruding from the left and right sides of the main body to have plate shapes, and which have the lower surfaces positioned lower than a lower surface of the spatula portion.

With this structure, the lower surfaces of the block-shaped guide portions can be used as guiding surfaces. Accordingly, the forward movement of the fusible toy bead scraper can be stably guided. Besides, since the fusible toy bead scraper can be moved forward also by pushing rear surfaces of the block-shaped guide portions, the assembly of the fusible toy beads can be further easily removed.

According to a fifth aspect of the present invention, in the fusible toy bead scraper, the guide portions include: lateral plate portions protruding from upper portions of the left and right plate-shaped guide portions to have plate shapes; and block-shaped guide portions protruding downward from lower surfaces of the lateral plate portions.

With this structure, the fusible toy bead scraper having both a structure guiding the spatula portion of the fusible toy bead scraper utilizing edge walls of a holding tray and a structure including the block-shaped guide portions can be integrally formed in an attractive shape.

According to a sixth aspect of the present invention, in the fusible toy bead scraper, the spatula portion is formed to have a horizontal lower surface.

When this structure is employed, since the tip of the spatula portion can be brought close to or into contact with a surface of a holding tray where recesses are formed, the forward movement of the spatula portion of the fusible toy bead scraper can be further stably guided.

The embodiment of the present invention has been described so far, and it is noted that the present invention is not limited to the above-described embodiment but can be variously modified without departing from the scope thereof.

For example, although the upper surface of the main body 10 of the fusible toy bead scraper 1 is formed as a flat surface in the present embodiment, the upper surface may be provided with a die stamped character or pattern using fine irregularities, or provided with fine irregularities (for example, irregularities in a wedge shape in a side view) for preventing an assembly of fusible toy beads from dropping off while removing it. Besides, although the upper surface of the main body 10 continuous from the upper surface of the spatula portion 20 is a flat surface in the present embodiment, the upper surface may be in a convex curved shape or a concave curved shape in a side view.

The invention claimed is:

1. A bead toy set comprising:

a plurality of water-soluble fusible toy beads;

a rectangular holding tray comprising:

a plurality of recesses formed on a surface of the holding tray, each recess configured to accommodate one of the plurality of water-soluble fusible toy beads; and an edge wall formed along a perimeter of the surface at each of four sides of the surface, the edge wall projecting from the surface; and a fusible toy bead scrape comprising:

a main body having a spatula portion formed on a front side of the main body that scrapes the fusible toy beads; and guide portions which extend from left and right outer surfaces of the main body, which have lower surfaces, and which are disposed on left and right sides of the main body, that guide forward and rearward movement of the spatula portion along the holding tray by sliding along respective left and right portions of the edge wall.

2. The bead toy set according to claim 1, wherein the main body is formed in a laterally long rectangular shape in a plan view and has a flat upper surface, and wherein an upper surface of the spatula portion is formed as a flat surface continuous from the flat upper surface of the main body.

3. The bead toy set according to claim 1, wherein the guide portions comprise plate-shaped guide portions which protrude from the left and right outer surfaces of the main body in parallel with the left and right outer surfaces, respectively, wherein the lower surfaces are positioned higher than a lower surface of the main body.

4. The bead toy set according to claim 3, wherein the guide portions further comprise;

lateral plate portions protruding from upper portions of the left and right plate-shaped guide portions; and block-shaped guide portions protruding downward from lower surfaces of the lateral plate portions.

5. The head toy set according to claim 1, wherein the guide portions comprise block-shaped guide portions which protrude downward from lower surfaces of lateral plate portions protruding from the left and right sides of the main body, the block-shaped guide portions having lower surfaces positioned lower than a lower surface of the spatula portion.

6. The bead toy set according to claim 1, wherein the spatula portion is formed to have a horizontal lower surface.

* * * * *